US008534265B2

(12) United States Patent
Saruwatari

(10) Patent No.: US 8,534,265 B2
(45) Date of Patent: Sep. 17, 2013

(54) FUEL SUPPLY CONTROL APPARATUS FOR INTERNAL COMBUSTION ENGINE AND FUEL SUPPLY CONTROL METHOD THEREOF

(75) Inventor: Masayuki Saruwatari, Isesaki (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 308 days.

(21) Appl. No.: 12/889,490

(22) Filed: Sep. 24, 2010

(65) Prior Publication Data

US 2011/0238282 A1 Sep. 29, 2011

(30) Foreign Application Priority Data

Mar. 23, 2010 (JP) ..... 2010-065762

(51) Int. Cl.
*F02M 37/04* (2006.01)

(52) U.S. Cl.
USPC ..... 123/497; 123/672; 123/674; 123/675

(58) Field of Classification Search
USPC ..... 123/497–499, 672–675, 446–447; 701/103–104, 109
See application file for complete search history.

(56) References Cited

U.S. PATENT DOCUMENTS

| | | | | | |
|---|---|---|---|---|---|
| 4,864,997 | A * | 9/1989 | Miyachi | 123/674 |
| 5,483,940 | A * | 1/1996 | Namba et al. | 123/497 |
| 5,694,902 | A * | 12/1997 | Miwa et al. | 123/493 |
| 5,699,772 | A * | 12/1997 | Yonekawa et al. | 123/497 |
| 5,715,797 | A * | 2/1998 | Minagawa et al. | 123/497 |
| 5,723,780 | A * | 3/1998 | Miwa et al. | 73/114.43 |
| 5,819,709 | A * | 10/1998 | Holmes et al. | 123/497 |
| 5,842,454 | A * | 12/1998 | Miwa et al. | 123/497 |
| 6,026,794 | A * | 2/2000 | Kadowaki et al. | 123/674 |
| 6,122,589 | A * | 9/2000 | Yamaguchi et al. | 701/106 |
| 6,138,655 | A * | 10/2000 | Kerns et al. | 123/674 |
| 6,234,148 | B1 * | 5/2001 | Hartke et al. | 123/447 |
| 6,283,106 | B1 * | 9/2001 | Kadowaki et al. | 123/674 |
| 6,367,455 | B2 * | 4/2002 | Hirata et al. | 123/497 |
| 6,450,158 | B2 * | 9/2002 | Takahashi et al. | 123/681 |
| 6,474,306 | B2 * | 11/2002 | Muller et al. | 123/479 |
| 6,488,012 | B1 * | 12/2002 | Suffredini et al. | 123/458 |
| 6,591,183 | B2 * | 7/2003 | Ishikawa et al. | 701/103 |
| 6,701,905 | B1 * | 3/2004 | Gaskins | 123/674 |

(Continued)

FOREIGN PATENT DOCUMENTS

| | | | |
|---|---|---|---|
| JP | 09-126027 | | 5/1997 |
| JP | 10103180 | A * | 4/1998 |
| WO | WO 9820307 | A1 * | 5/1998 |

*Primary Examiner* — Stephen K Cronin
*Assistant Examiner* — Joseph Dallo
(74) *Attorney, Agent, or Firm* — Antonelli, Terry, Stout & Kraus, LLP.

(57) ABSTRACT

The present invention relates to a fuel supply control apparatus and a fuel supply control method for controlling an electric fuel pump, in an internal combustion engine provided with the electric fuel pump for pumping fuel to a fuel injection valve and a pressure regulator for regulating fuel pressure at set pressure. When a learning condition of a drive voltage for the electric fuel pump is established, the drive voltage is temporarily reduced and a change amount ΔAF of an air-fuel ratio at the time is detected. Then, if the change amount ΔAF is within a first threshold ΔAF1, the drive voltage is reduced, whereas, if the change amount ΔAF is greater than a second threshold ΔAF2 which is equal to or greater than the first threshold ΔAF1, the drive voltage is increased.

20 Claims, 5 Drawing Sheets

(56) References Cited

U.S. PATENT DOCUMENTS

| | | | | |
|---|---|---|---|---|
| 6,907,857 | B2 * | 6/2005 | Saito et al. | 123/299 |
| 6,910,464 | B2 * | 6/2005 | Ishikawa et al. | 123/458 |
| 6,925,990 | B1 * | 8/2005 | Konopacki | 123/497 |
| 7,025,050 | B2 * | 4/2006 | Oono et al. | 123/690 |
| 7,137,386 | B1 * | 11/2006 | Ruiz | 123/674 |
| 7,143,747 | B2 * | 12/2006 | Uchiyama | 123/456 |
| 7,431,020 | B2 * | 10/2008 | Ramamurthy | 123/497 |
| 7,455,058 | B2 * | 11/2008 | Raffesberger | 123/694 |
| 7,472,690 | B2 * | 1/2009 | Takayanagi et al. | 123/446 |
| 7,503,313 | B2 * | 3/2009 | Achleitner et al. | 123/446 |
| 7,614,392 | B2 * | 11/2009 | Fukagai et al. | 123/688 |
| 7,784,446 | B2 * | 8/2010 | Rumpf | 123/497 |
| 8,091,530 | B2 * | 1/2012 | Surnilla et al. | 123/446 |
| 8,155,859 | B2 * | 4/2012 | Nakata et al. | 701/103 |
| 8,210,155 | B2 * | 7/2012 | Ohta et al. | 123/446 |
| 8,235,026 | B2 * | 8/2012 | Yamaguchi et al. | 123/491 |
| 8,245,693 | B2 * | 8/2012 | Surnilla et al. | 123/446 |
| 2003/0029423 | A1 * | 2/2003 | Boehland et al. | 123/450 |
| 2003/0150208 | A1 * | 8/2003 | Hirata et al. | 60/285 |
| 2005/0005912 | A1 * | 1/2005 | Joos et al. | 123/458 |
| 2005/0072410 | A1 * | 4/2005 | Ohsaki | 123/674 |
| 2005/0103312 | A1 * | 5/2005 | Uchiyama | 123/457 |
| 2007/0215115 | A1 * | 9/2007 | Hazama | 123/458 |
| 2007/0251501 | A1 * | 11/2007 | Sawut et al. | 123/458 |
| 2008/0306648 | A1 * | 12/2008 | Takahashi | 701/29 |
| 2008/0314364 | A1 * | 12/2008 | Okamoto | 123/458 |
| 2009/0025683 | A1 * | 1/2009 | Culbertson et al. | 123/446 |
| 2009/0095052 | A1 * | 4/2009 | Inoue et al. | 73/23.32 |
| 2009/0299601 | A1 * | 12/2009 | Kunihiro | 701/102 |
| 2010/0274467 | A1 * | 10/2010 | Hayami | 701/103 |
| 2010/0282214 | A1 * | 11/2010 | Albrecht et al. | 123/457 |
| 2010/0307459 | A1 * | 12/2010 | Steinbach et al. | 123/511 |
| 2011/0132328 | A1 * | 6/2011 | Attwood et al. | 123/456 |
| 2011/0206539 | A1 * | 8/2011 | Mori et al. | 417/42 |
| 2012/0097132 | A1 * | 4/2012 | Suda | 123/457 |

* cited by examiner

FUEL SUPPLY CONTROL APPARATUS FOR INTERNAL COMBUSTION ENGINE AND FUEL SUPPLY CONTROL METHOD THEREOF

BACKGROUND OF THE INVENTION

1. Field of the Invention

The present invention relates to a fuel supply control apparatus for an internal combustion engine and a fuel supply control method thereof, and, in particular, to a fuel supply control apparatus and a fuel supply control method for controlling an electric fuel pump, in an internal combustion engine which is provided with the electric fuel pump for pumping fuel to a fuel injection valve and a pressure regulator for regulating fuel pressure at set pressure.

2. Description of Related Art

Japanese Laid-open (Kokai) Patent Application Publication No. 9-126027 discloses an apparatus is provided with a sensor for detecting a flow amount of fuel to be returned to a fuel tank via a pressure regulator, the apparatus controls a drive current for a fuel pump based on the fuel flow amount detected by the sensor.

According to the apparatus as described above, an excessive fuel amount to be returned to the fuel tank via the pressure regulator can be reduced.

However, the apparatus provided with the sensor for detecting the flow amount has a problem in high cost performance since the sensor is disposed. Furthermore, the flow amount detected by the sensor pulsates, and thus, there is a problem in that the excessive fuel amount is hard to be controlled with high precision.

SUMMARY OF THE INVENTION

Therefore, in view of the above problems, the present invention has an object to provide a fuel supply control apparatus for an internal combustion engine and a fuel supply control method thereof, capable of reducing an excessive fuel flow amount with high precision at a low cost.

In order to achieve the above-mentioned object, a fuel supply control apparatus according to the present invention includes: an electric power reducing unit which temporarily reduces driving electric power for an electric fuel pump; a pressure estimating unit which estimates a change amount of fuel pressure for when the driving electric power is temporarily reduced; and an electric power correcting unit which corrects the driving electric power based on the change amount of the fuel pressure.

Furthermore, in order to achieve the above-mentioned object, a fuel supply control method according to the present invention, temporarily reduces driving electric power for an electric fuel pump; estimates a change amount of fuel pressure for when the driving electric power is temporarily reduced; and corrects the driving electric power based on the change amount.

The other objects and features of this invention will become understood from the following description with reference to the accompanying drawings.

DESCRIPTION OF PREFERRED EMBODIMENTS

Figure 1:
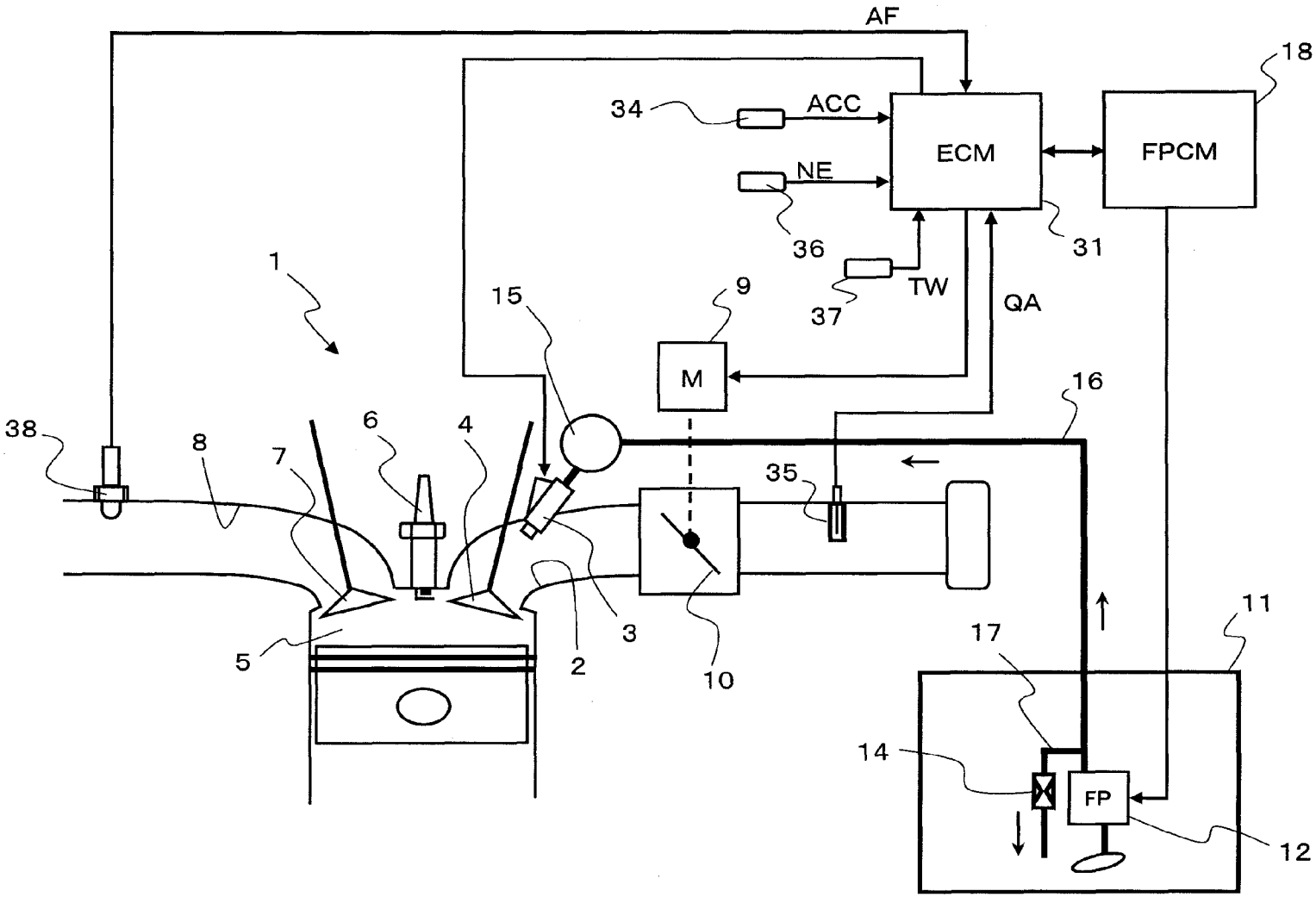
FIG. 1 is a view illustrating an internal combustion engine in an embodiment of the present invention.

FIG. 1 is a view illustrating a vehicular internal combustion engine 1 provided with a fuel supply control apparatus according to the present invention.

In FIG. 1, internal combustion engine 1 is provided with a fuel injection valve 3 in an intake passage 2, and sucks fuel injected by fuel injection valve 3 together with air into a combustion chamber 5 via an intake valve 4.

The fuel in combustion chamber 5 is ignited to be combusted by spark ignition by an ignition plug 6, and internal combustion engine 1 discharges combusted gas in combustion chamber 5 to an exhaust passage 8 via an exhaust valve 7.

Internal combustion engine 1 is provided with an electronically controlled throttle 10 which is driven to open or close by a throttle motor 9, in intake passage 2 on the upstream side of fuel injection valve 3. Electronically controlled throttle 10 regulates an intake air amount of internal combustion engine 1.

Furthermore, internal combustion engine 1 is provided with a fuel supply device which pumps fuel in a fuel tank 11 to fuel injection valve 3 by the use of a fuel pump 12.

The fuel supply device includes fuel tank 11, fuel pump 12, a mechanical pressure regulator 14, fuel gallery piping 15, fuel supply piping 16 and fuel return piping 17.

Fuel pump 12 is an electrical pump of which pump impeller is driven to rotate by the use of an electric motor.

Fuel supply piping 16 connects a discharge port of fuel pump 12 to fuel gallery piping 15. To fuel gallery piping 15, a fuel supply port of each fuel injection valve 3 is connected.

Fuel return piping 17 is branched at one end thereof from fuel supply piping 16 in fuel tank 11 and the other end thereof opens into fuel tank 11.

Pressure regulator 14 is provided with a valve body which opens or closes fuel return piping 17, and an elastic member, such as a coil spring or the like, which presses the valve body toward a valve seat on the upstream side of fuel return piping 17. Then, pressure regulator 14 is opened when fuel pressure PF in fuel supply piping 16 becomes higher than set pressure SL, to relieve the fuel in fuel supply piping 16 into fuel tank 11, while being closed when the fuel pressure PF in fuel supply piping 16 becomes lower than the set pressure SL, to maintain the fuel pressure PF in the vicinity the set pressure SL. The set pressure SL is set at 350 kPa, for example.

A FPCM (Fuel Pump Control Module) 18 controls driving electric power for electric fuel pump 12, to thereby control a discharge amount of fuel pump 12 and discharge pressure thereof. To be specific, FPCM 18 is configured for controlling a drive voltage to be applied to a direct current motor which constitutes up electrical fuel pump 12, or for controlling a drive current which flows to the direct current motor at a target drive current, so that the discharge amount of fuel pump 12 and the discharge pressure thereof are controlled by changing the drive voltage or the target drive current.

On the other hand, an ECM (Engine Control Module) 31 outputs manipulated signals to fuel injection valve 3, electronically controlled throttle 10 and the like, and also, the ECM computes an indicated value of manipulated variable of fuel pump 12 to output the indicated value to FPCM 18.

Incidentally, ECM 31 may be provided with hardware of FPCM 18 and a control function thereof.

ECM 31 receives output signals from various types of sensors which detect operating conditions of internal combustion engine 1, and computes manipulated variables of fuel injection valve 3, electronically controlled throttle 10 and the like, based on these output signals, and furthermore, computes the indicated value of the manipulated variable of fuel pump 12.

As the various types of sensors described above, there are disposed: an accelerator opening sensor 34 for detecting a stroke amount ACC of an accelerator pedal (not shown in the figure); an air flow sensor 35 for detecting an intake air flow amount QA of internal combustion engine 1; a rotation sensor 36 for detecting a rotating speed NE of internal combustion engine 1; a water temperature sensor 37 for detecting cooling water temperature TW of internal combustion engine 1; an air-fuel ratio sensor 38 for detecting an air-fuel ratio AF of internal combustion engine 1 according to oxygen concentration in the exhaust gas; and the like.

ECM 31 computes a basic injection pulse width TP of fuel injection valve 3, based on the intake air flow amount QA and the engine rotating speed NE. Furthermore, ECM 31 computes an air-fuel ratio feedback correction coefficient for approaching the air-fuel ratio detected by the air-fuel ratio sensor 38 to a target air-fuel ratio, a correction coefficient for increasing a fuel injection amount when the engine is cooled down or in a high load region and the like, and corrects the basic injection pulse width TP based on these correction coefficients, to thereby compute a final injection pulse with TI.

Then, ECM 31 outputs an injection pulse signal of the injection pulse width TI to fuel injection valve 3 at injection timing of each cylinder, to control fuel injection by fuel injection valve 3.

Fuel injection valve 3 is driven to open for a period of time corresponding to the injection pulse width TI, to inject the fuel of amount proportional to a valve opening time.

Furthermore, ECM 31 computes ignition timing based on engine operating conditions, such as, a load of internal combustion engine 1, the engine rotating speed NE and the like, to control power supply to an ignition coil (not shown in the figure) so that spark ignition by ignition plug 6 is performed at the computed ignition timing.

Moreover, ECM 31 computes target opening of electronically controlled throttle 10 based on the accelerator opening ACC and the like, to control throttle motor 9 so that opening of electronically controlled throttle 10 reaches target opening.

In the followings, computation processing of the indicated value of the drive voltage for fuel pump 12, in other words, computation processing of the manipulated variable of fuel pump 12 will be described in detail.

Figure 2:
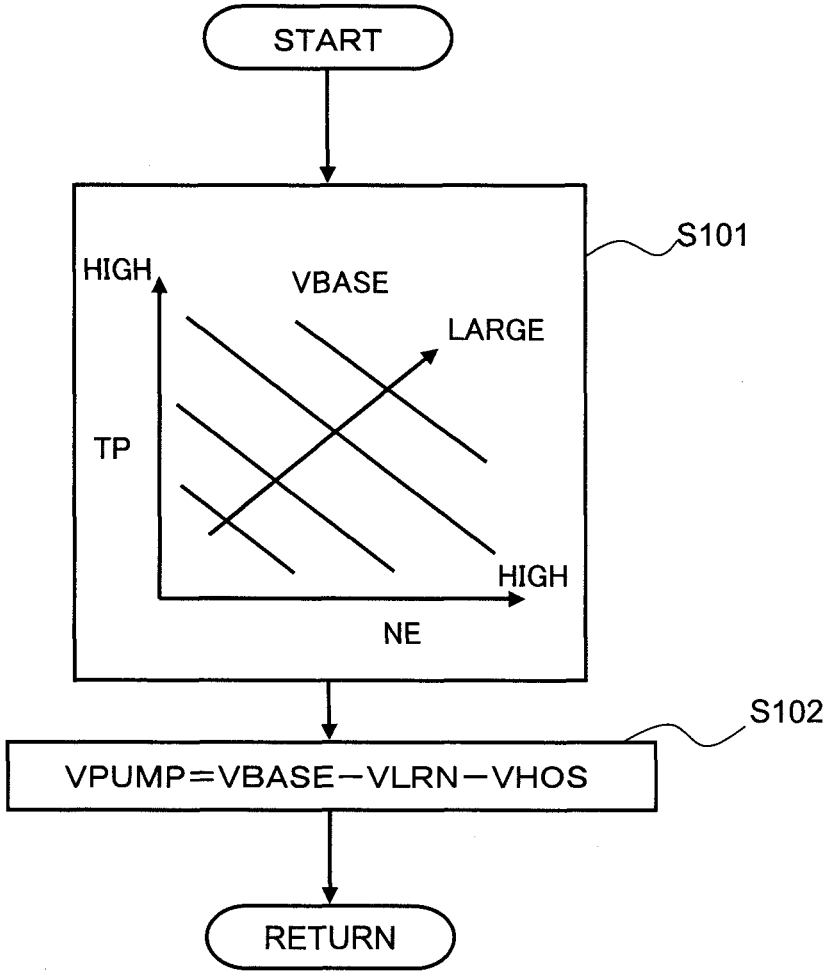
FIG. 2 is a flowchart illustrating a setting process of a drive voltage in the embodiment of the present invention.

A flowchart of FIG. 2 illustrates a computing process of the drive voltage for fuel pump 12, which is interruptedly executed for each set time by ECM 31. The set time is about 10 ms, for example.

In step S101, a basic drive voltage VBASE is calculated according to the operating conditions of internal combustion engine 1.

Incidentally, fuel pump 12 in this embodiment has characteristics in that the discharge amount/discharge pressure thereof is increased as the drive voltage/drive current becomes higher.

ECM 31 calculates the basic drive voltage VBASE, based on the basic injection pulse width TP representing the engine load and the engine rotating speed NE. To be specific, ECM 31 calculates the basic drive voltage VBASE to have a higher value, as the engine rotating speed NE becomes higher, and also, as the engine load becomes higher.

However, the discharge amount of fuel pump 12 may be less than a design value due to characteristic variations in fuel pump 12, and accordingly, if the drive voltage is set at a value for obtaining a required discharge amount, the fuel pressure PF may become lower than the set pressure SL due to the lack of discharge amount. Then, if the fuel pressure PF is lower than the set pressure SL, the injection amount per unit valve opening time of fuel injection valve 3 is decreased, so that an air-fuel ratio of air-fuel mixture may become leaner, resulting in misfire.

Therefore, in order that, even if the discharge amount of fuel pump 12 becomes less than the design value, pressure regulator 14 relieves the fuel so that the fuel pressure PF is maintained at the set pressure SL, the basic drive voltage VBASE is set to be higher than a requisite minimum value so that the discharge amount greater than the required discharge amount can be obtained.

If the basic drive voltage VBASE is calculated in step S101, and then, in step S102, the basic drive voltage VBASE is corrected based on a first correction value VLRN and a second correction value VHOS, and a correction result is set at a final drive voltage VPUMP.

To be specific, as shown in the following formula, a value which is obtained by subtracting, from the basic drive voltage VBASE, the first correction value VLRN and further, the second correction value VHOS, is set as the final drive voltage VPUMP.

$$VPUMP = VBASE - VLRN - VHOS$$

The first correction value VLRN is a learning value for decreasing as much as possible the fuel amount to be relieved by pressure regulator 14, and is updated by ECM 31 in accordance with a flowchart of FIG. 3 as described below.

That is, in a state in which pressure regulator 14 does not relieve the fuel, the fuel pressure PF is lower than the set pressure SL. However, in a state in which the fuel amount relieved by pressure regulator 14 is excessive, fuel pump 12 works more than necessary, resulting in an increase in the electric power consumption.

Therefore, the basic drive voltage VBASE is set to be higher so that, even if the discharge amount of fuel pump 12 becomes the lowest within a variation range, the fuel to be relieved by pressure regulator 14 is obtained and the fuel pressure PF can be maintained at the set pressure SL. If the fuel amount to be practically relieved is excessive, the drive voltage VPUMP is corrected to be lower based on the first correction value VLRN.

Furthermore, the second correction value VHOS is a value for temporarily changing the drive voltage VPUMP to intentionally occur a change of the air-fuel ratio, in order to judge whether or not the first correction value VLRN is a proper value.

ECM 31 transmits, to FPCM 18, a voltage indication signal indicating the drive voltage VPUMP, and FPCM 18 received the voltage indication signal determines a duty ratio according to the drive voltage VPUMP, to control ON/OFF of a switching element which turns on/off the power supply to fuel pump 12 in accordance with the duty ratio.

Figure 3:
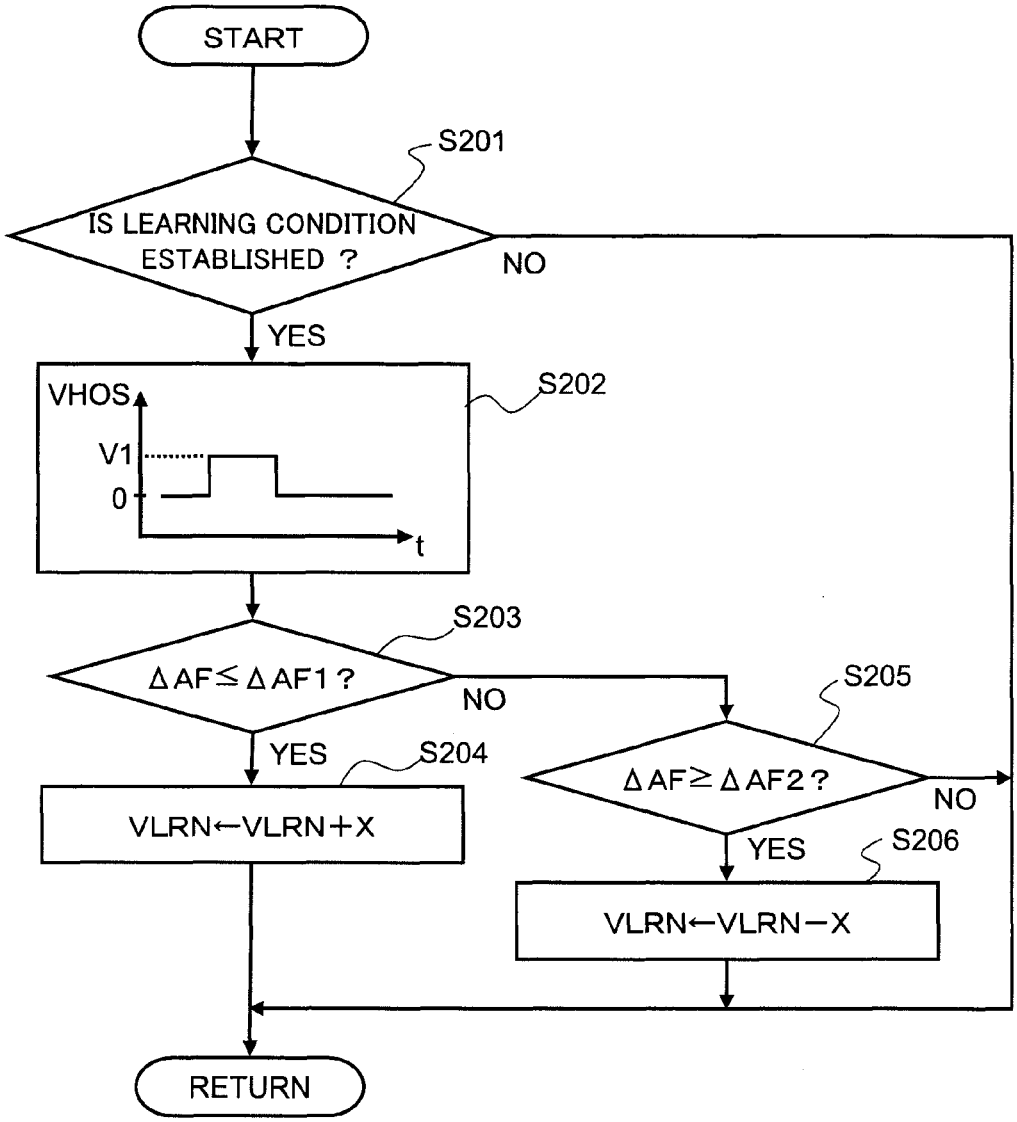
FIG. 3 is a flowchart illustrating a learning process of the drive voltage in the embodiment of the present invention.

The flowchart of FIG. 3 shows a learning process of the drive voltage, which is interruptedly executed for each set time by ECM 31.

In step S201, it is judged whether or not a learning condition of the first correction value VLRN is established.

As the learning condition, it is judged whether or not internal combustion engine 1 is in a stationary state. To be specific, when a change amount per unit time ΔST of the accelerator opening ACC, the engine load, the engine rotating speed NE or the like, is less than a threshold SLA, it is judged that internal combustion engine 1 is in the stationary state, whereas when the change amount per unit time ΔST is greater than the threshold SLA, it is judged that internal combustion engine 1 is in a transient state.

Then, if internal combustion engine 1 is in the stationary state, it is judged that the learning condition is established, and the routine proceeds to step S202.

Incidentally, as the learning condition, it may be judged that the warm-up of internal combustion engine 1 is completed, a transmission connected to an output shaft of internal combustion engine 1 in a neutral state, an elapsed time after the operation start of internal combustion engine 1 exceeds the set time, fuel temperature is lower than upper limit temperature, an external load of an air-conditioner compressor or the like which is driven by internal combustion engine 1 is in a stable state, an operation of the external load is stopped, the engine load and the engine rotating speed are within set regions, or the like.

In step S202, the second correction value VHOS is increased in stepwise from 0V being an initial value up to a set value V1 (V1>0V), and then, is returned to 0V from the set value V1 after a lapse of a set time t1 (not shown in drawings).

That is, the second correction value VHOS is kept at the set value V1 for the set time t1 in a learning mode, while being kept at 0V in modes other than the learning mode.

If the second correction value VHOS is set at the positive value V1 greater than 0V, the drive voltage VPUMP is reduced by the second correction value VHOS, so that the discharge amount of fuel pump 12 is decreased.

Here, the set time t1 which is a period of time for temporarily reducing the drive voltage VPUMP based on the second correction value VHOS, and the set value V1 which reduces the drive voltage VPUMP, are set so that the air-fuel ratio becomes leaner as a result that the injection amount per unit time of fuel injection valve 3 is decreased by the reducing-correction of the drive voltage VPUMP, and also, the air-fuel ratio is changed at the degree detectable by air-fuel ratio sensor 38, and furthermore, are set at the degree of avoiding misfire due to over-leaning of the air-fuel ratio or a shock due to torque decrease sensed by a driver.

That is, by temporarily reducing the drive voltage VPUMP based on the second correction value VHOS, such a situation is intentionally occurred in which the discharge amount of fuel pump 12 becomes deficient, so that the fuel relief from pressure regulator 14 is stopped and the fuel pressure PF becomes lower than the set pressure SL. However, the set time t1 and the set value V1 are adjusted so that, when the drive voltage VPUMP is intentionally reduced, misfire or large torque decrease does not occur, and furthermore, the leaning of the air-fuel ratio can be detected by air-fuel ratio sensor 38.

Here, if the set time t1 and the set value V1 are less than proper values, the air-fuel ratio change at the degree detectable by air-fuel ratio sensor 38 does not occur, or it becomes hard to detect variations in the air-fuel ratio due to combustion variations among the cylinders or fuel pulsation separately from the air-fuel ratio change due to the reduction of the drive voltage. On the contrary, if the set time t1 and the set value V1 are greater than the proper values, there occurs misfire due to the over-leaning of the air-fuel ratio or a torque shock sensed by a driver.

Therefore, the set time t1 and the set value V1 are set at the degree detectable of the air-fuel ratio change while suppressing degradation in operating performance of internal combustion engine 1.

Incidentally, a period of time during which the drive voltage VPUMP is reduced by the set value V1 may be set as a period of time until an integrated value of engine rotating numbers and an integrated value of intake air amount exceed thresholds, and furthermore, the set value V1 and the period of time during which the drive voltage VPUMP is temporarily reduced based on the set value V1 may be variably set according to the operating conditions, such as the engine load, the engine rotating speed and the like.

If the drive voltage VPUMP is temporarily reduced based on the second correction value VHOS in step S202, and then in step S203, it is judged whether or not a change amount ΔAF of the air-fuel ratio due to the reduction of the drive voltage VPUMP is within a first threshold ΔAF1.

Here, when the discharge amount of fuel pump 12 is decreased due to the reduction of the drive voltage VPUMP, so that supply pressure of the fuel to fuel injection valve 3 becomes lower than the set pressure SL of pressure regulator 14, the fuel amount injected per unit time by fuel injection valve 3 is decreased, so that the air-fuel ratio becomes leaner, and therefore, the change amount ΔAF of the air-fuel ratio indicates a lean change amount of the air-fuel ratio due to the decrease of the fuel pressure PF associated with the reduction of the drive voltage VPUMP.

That is, the decrease of the fuel pressure PF associated with the reduction of the drive voltage VPUMP is estimated based on the lean change amount of the air-fuel ratio.

However, there is a delay until air-fuel ratio sensor 38 detects the air-fuel ratio change which occurs as a result that the drive voltage VPUMP is reduced based on the second correction value VHOS. Therefore, a period of time in which the delay is predicted from correction timing of the pump drive voltage VPUMP is set as a sampling period for the air-fuel ratio detected by air-fuel ratio sensor 38. Then, during the sampling period, the change amount ΔAF between a mean air-fuel ratio for when the drive voltage VPUMP is not corrected based on the second correction value VHOS, in other words, for when the second correction value VHOS=0V, and the air-fuel ratio detected by air-fuel ratio sensor 38, is detected for each sampling cycle of an output from air-fuel ratio sensor 38.

Then, a maximum value among the change amounts ΔAF detected during the sampling period, that is, the change amount ΔAF for when the air-fuel ratio is changed to the most leaning side during the sampling period, is detected as the change amount ΔAF of the air-fuel ratio as a result that the drive voltage VPUMP is reduced based on the second correction value VHOS. The change amount ΔAF of the air-fuel ratio is calculated as an absolute value.

Incidentally, it is possible to detect the air-fuel ratio in a state in which the air-fuel ratio is stable on the lean side during the sampling period or the change amount ΔAF of the air-fuel ratio based on the mean air-fuel ratio in this stable state, and if such a configuration is applied, it is possible to suppress an adverse effect, such as the air-fuel ratio variations, overshooting to the leaner side or the like, to thereby detect the air-fuel ratio change amount ΔAF with high precision.

The case in which the change amount ΔAF of the air-fuel ratio is within the first threshold ΔAF1 means the case in which, even if the drive voltage VPUMP is reduced based on the second correction value VHOS, the decrease of the discharge amount due to the reduction of the drive voltage VPUMP does not cause the decrease of relief amount of the fuel from pressure regulator 14 or the large decrease of the fuel pressure PF.

That is, in a state in which pressure regulator 14 relieves the excessive fuel to fuel tank 11, the discharge amount of fuel pump 12 is greater than the consumed fuel amount in internal combustion engine 1 at the time, and even if the discharge amount is decreased by the excessive fuel, the fuel supply pressure to fuel injection valve 3 can be maintained, and accordingly, the fuel pressure is decreasingly changed by the decreased discharge amount which is over the excessive fuel, so that the air-fuel ratio becomes leaner.

Accordingly, in the case in which, even if the drive voltage VPUMP is reduced based the second correction value VHOS, the air-fuel ratio change matched with the voltage reduction does not occur, it is possible to estimate that the too much excessive fuel is obtained in a state in which the drive voltage VPUMP is not reduced based on the second correction value VHOS.

However, if the fuel amount to be relieved by pressure regulator 14 is too small, there is a possibility that the fuel pressure PF becomes temporarily lower than the set pressure SL due to pulsation associated with the injection operation, and therefore, the excessive fuel amount, which can maintain the fuel pressure even if the pulsation associated with the injection operation occurs, is determined as an allowable minimum amount (allowable minimum amount>0), and the first threshold ΔAF1 is set so that the excessive fuel of allowable minimum amount cab be secured.

In other words, if the change amount ΔAF of the air-fuel ratio is within the first threshold ΔAF1, it is possible to estimate that the excessive fuel is in the too much excessive state in which the excessive fuel is over the allowable minimum amount.

Therefore, in step S203, if it is judged that the change amount ΔAF of the air-fuel ratio is within the first threshold ΔAF1, the routine proceeds to step S204, in which the previous first correction value VLRN is increased by a correction value X (VHOS≦X), and the first correction value VLRN after increased is stored.

If a lean change of the air-fuel ratio occurred due to the temporary reduction of the drive voltage VPUMP is sufficiently small, it is judged that the excessive fuel of allowable minimum amount can be ensured even if the pump drive voltage is reduced by at least the correction value X, and the first correction value VLRN is increased by the correction value X while the drive voltage VPUMP being reduced by the correction value X, so that the discharge amount of fuel pump 12 and further the excessive fuel to be relieved by pressure regulator 14 are decreased.

That is, the basic pump drive voltage VBASE is set to be higher so that the excessive fuel becomes at least the allowable minimum amount even if the discharge amount relative to the drive voltage VPUMP becomes a minimum value due to various variation factors.

Therefore, the excessive discharge amount due to the basic pump drive voltage VBASE is decreased based on the first correction value VLRN, and if the discharge amount of fuel pump 12 causes the too much excessive fuel, the first correction value VLRN is increased while the drive voltage VPUMP being reduced.

Accordingly, it is possible to learn the drive voltage at which the excessive fuel becomes a lower limit amount in fuel pump 12, in other words, a further lower drive voltage within a drive voltage range in which the required injection amount can be ensured, and it is possible to suppress that the too much drive voltage causing the too much excessive fuel amount is applied to fuel pump 12, to reduce the power consumption of fuel pump 12, to thereby improve the fuel consumption performance of internal combustion engine 1.

Incidentally, an initial value of the first correction value VLRN is 0V, and may be a uniform correction value to be used for all operating regions. Or, the first correction value VLRN may be stored in updatable as an individual value for each of a plurality of operating regions which are separated from one another based on the engine load and the engine rotating speed for example, so that the value stored in response to the corresponding operating region at the time can be updated, and also, the drive voltage VPUMP can be calculated based on the value stored in response to the corresponding operating region at the time.

On the other hand, in step S203, if it is judged that the change amount ΔAF of the air-fuel ratio is not within the first threshold ΔAF1, in other words, if the air-fuel ratio becomes leaner for over a predetermined value due to the temporary reduction of the drive voltage VPUMP, it is judged that the excessive fuel becomes less than the allowable minimum amount if the pump drive voltage VPUMP is further reduced by the correction value X, and the routine proceeds to step S205.

That is, it is judged that, as the leaning of air-fuel ratio due to the temporary reduction of the drive voltage VPUMP is larger, the excessive fuel amount is small in the state in which the drive voltage VPUMP is not reduced based on the second correction value VHOS, whereas, if the change amount ΔAF of the air-fuel ratio is greater than the first threshold ΔAF1, the excessive fuel amount is in the vicinity of the allowable minimum amount, and accordingly, it is not possible to perform at least the further decrease of the excessive fuel amount.

In step S205, it is judged whether or not the change amount ΔAF of the air-fuel ratio, which occurred when the drive voltage VPUMP was temporarily reduced, is equal to or greater than a second threshold ΔAF2 (ΔAF2≧ΔAF1).

If the change amount ΔAF of the air-fuel ratio is less than the second threshold ΔAF2, it is judged that, although there is no room for further reducing the pump drive voltage VPUMP, the excessive fuel of allowable minimum amount is obtained, and this routine is terminated directly, so that the value of the first correction value VLRN is maintained as the previous value.

On the other hand, if the change amount ΔAF of the air-fuel ratio, which occurred when the drive voltage VPUMP was temporarily reduced, is equal to or greater than the second threshold ΔAF2, it is judged that the excessive fuel in the state in which the drive voltage VPUMP is not reduced based on the second correction value VHOS, is less than the allowable minimum amount, and the routine proceeds to step S206.

In step S206, the previous first correction value VLRN is decreased by the correction value X, and the first correction value VLRN after decreased is stored.

That is, if the change amount ΔAF of the air-fuel ratio, which occurs when the drive voltage VPUMP is temporarily reduced, is equal to or greater than the second threshold ΔAF2, it is possible to estimate that the drive voltage VPUMP is excessively reduced based on the first correction value VLRN, and also, the excessive fuel amount is less than the allowable minimum amount. Therefore, by decreasing the first correction value VLRN while increasing the drive voltage VPUMP and furthermore the discharge amount of fuel pump 12, the excessive fuel over the allowable fuel amount is obtained.

Then, as a result that the first correction value VLRN is decreased in step S206, if the change amount ΔAF of the air-fuel ratio, which occurs when the drive voltage VPUMP is temporarily reduced, becomes less than the second threshold ΔAF2, it is estimated that at least the excessive fuel of allowable minimum amount is obtained, and the decrease of the first correction value VLRN is stopped.

Accordingly, if the pump discharge amount obtained relative to the drive voltage VPUMP is decreased due to deterioration with time of fuel pump 12 or the like, the drive voltage VPUMP is increased, to thereby obtain the excessive amount of allowable minimum amount.

Incidentally, a decreasing-correction range of the first correction value VLRN in step S206, in other words, an increasing-correction range of the drive voltage VPUMP, may be same as an increasing-correction range of the first correction value VLRN in step S204, in other words, a reducing-correction range of the drive voltage VPUMP. Or, the decreasing-correction range of the first correction value VLRN in step S206 may be set to be wider than the increasing-correction range of the first correction value VLRN in step S204.

This is because, in the case in which the too much excessive fuel is obtained due to the excess of the drive voltage VPUMP, although the electric power consumption is increased, the fuel pressure PF can be regulated at the set pressure SL and the air-fuel ratio controllability can be maintained, whereas, in the state in which the drive voltage VPUMP is too low, since the fuel pressure PF for fuel injection valve 3 is lower than the set pressure SL and there is a possibility of misfire due to the leaning of the air-fuel ratio, it is desired that the fuel pressure is restored promptly.

Furthermore, in the decreasing-correction of the first correction value VLRN in step S206 and in the increasing-correction of the first correction value VLRN in step S204, if the correction is consecutively performed for increasing (or decreasing), it is possible to make the correction range of the first correction value VLRN smaller in stepwise, and thus, the drive voltage VPUMP can be further brought closer to the requisite minimum value.

Moreover, in the above embodiment, the change of the air-fuel ratio due to the temporary reduction of the drive voltage VPUMP is detected as a change of oxygen concentration in the exhaust gas by air-fuel ratio sensor 38, however, in the case in which a sensor for detecting an inner pressure of the cylinder is provided for misfire detection, a change of combustion pressure due to the leaning of the air-fuel ratio may be detected as a value equivalent to the air-fuel ratio change.

Still further, in a system in which the drive current for fuel pump 12 is controlled, it is possible to perform learning in that a target drive current is increased or reduced based on the air-fuel ratio change for when the drive current is temporarily reduced, and thus, the discharge pressure of fuel pump 12 is varied. A second embodiment in such a configuration will be described hereunder in accordance with flowcharts of FIG. 4 and FIG. 5.

Figure 4:
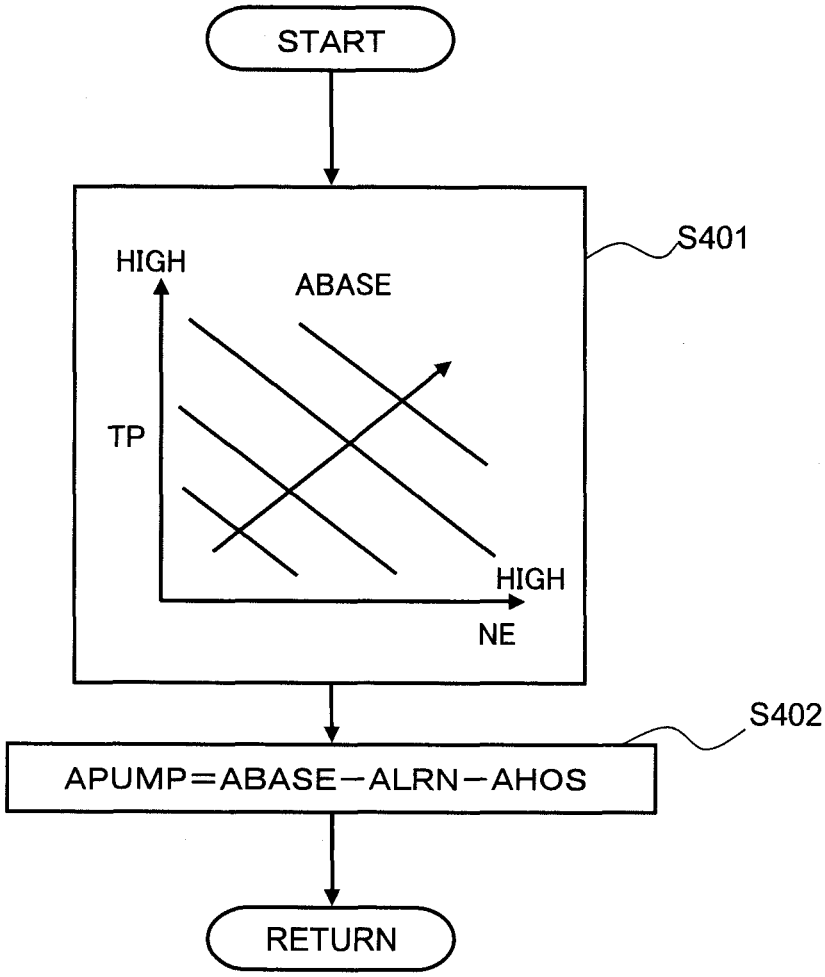
FIG. 4 is a flowchart illustrating a setting process of a target drive current in the embodiment of the present invention.

FIG. 4 is the flowchart illustrating a computing process of a target pump drive current, which is interruptedly executed for each set time by ECM 31.

In step S401, a basic drive current ABASE is calculated according to the operating conditions of internal combustion engine 1.

The basic drive current ABASE is set as a value at which the excessive fuel is relieved by pressure regulator 14 even if there are the characteristic variations in fuel pump 12. Furthermore, since the variations in fuel pressure are increased on the high rotation/high load side, as illustrated in the figure, the basic drive current ABASE may be set to be higher on the high rotation/high load side.

After the basic pump drive current ABASE is calculated in step S401, and then, in step S402, the basic pump drive current ABASE is corrected based on a first correction value ALRN and a second correction value AHOS, and a correction result is set as a final target drive current APUMP.

To be specific, as shown in the following formula, a value obtained by subtracting, from the basic drive current ABASE, the first correction value ALRN and further, the second correction value AHOS, is set as the final target drive current APUMP.

$$APUMP = ABASE - ALRN - AHOS$$

Figure 5:
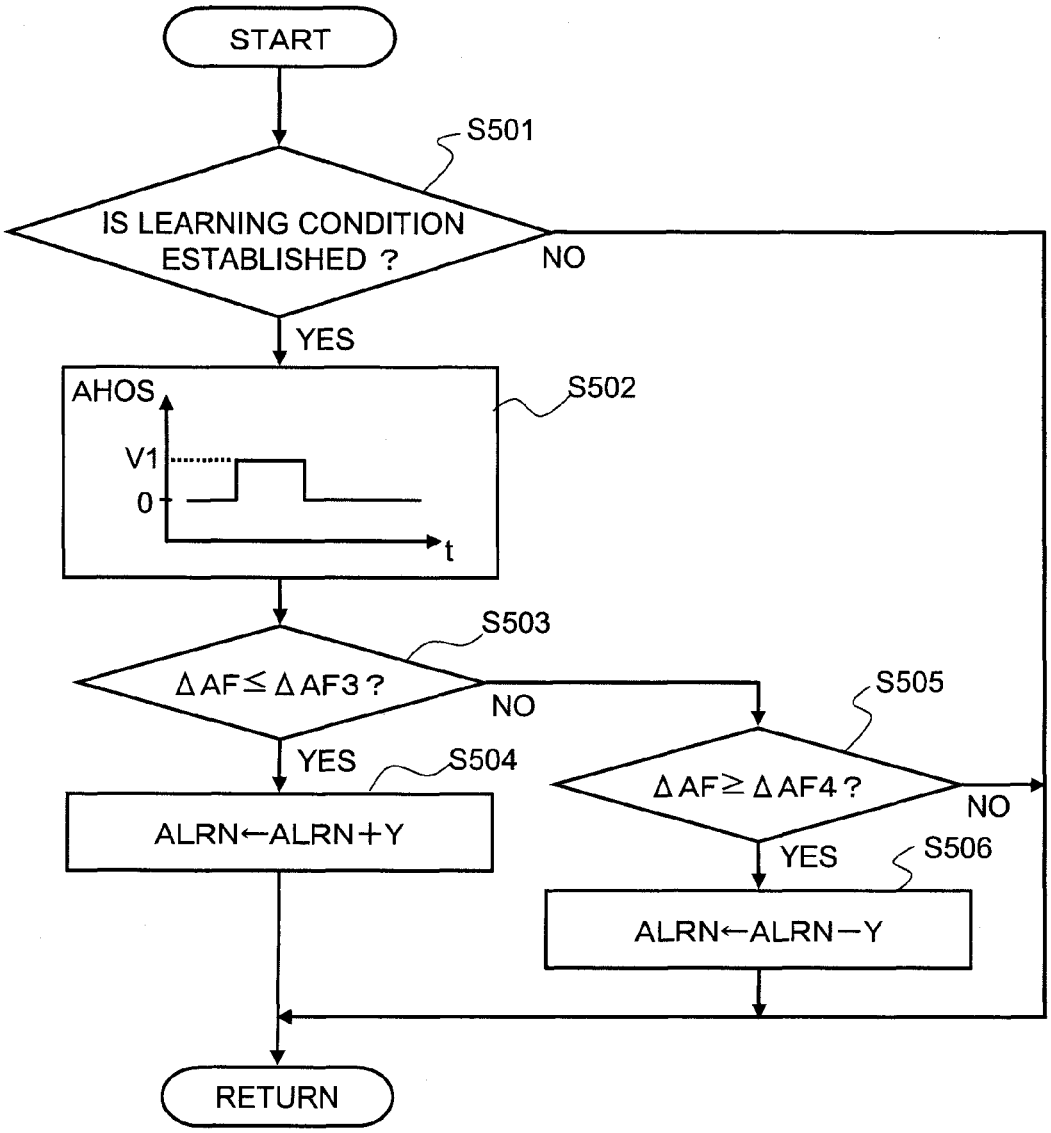
FIG. 5 is a flowchart illustrating a learning process of the target drive current in the embodiment of the present invention.

The first correction value ALRN is a learning value for decreasing as much as possible the too much excessive fuel due to the basic drive current ABASE, and ECM 31 performs the learning in accordance with the flowchart of FIG. 5.

Furthermore, the second correction value AHOS is a value for temporarily changing the target drive current APUMP to intentionally change the air-fuel ratio, in order to judge whether or not the first correction value ALRN is a proper value.

ECM 31 transmits, to FPCM 18, a signal indicating the target drive current APUMP, and FPCM 18 received the signal indicating the target drive current APUMP controls ON/OFF of a switching element which turns on/off the drive current to fuel pump 12, based on a duty ratio according to the target drive current APUMP.

FIG. 5 is the flowchart illustrating a learning process of the target drive current, which is interruptedly executed for each set time by ECM 31.

In step S501, similarly to step S201, it is judged whether or not a learning condition is established, and if it is judged that the learning condition is established, the routine proceeds to step S502.

In step S502, the second correction value AHOS is increased in stepwise from 0 being an initial value up to a set value A1 (not shown in drawings; A1>0A), and then, is returned in stepwise to 0 from the set value A1 after the lapse of the set time t1.

That is, the second correction value AHOS is maintained at the set value A1 for the set time t1 when the learning condition is established, while being maintained at 0 at other times.

As described in the above, the second correction value AHOS is the value to be subtracted from the basic drive current ABASE, and if the value of the second correction value AHOS is set at a positive value A1 greater than 0A, the target drive current APUMP is reduced by the second correction value AHOS and the discharge pressure of fuel pump 12 is decreased.

Here, similar to the set time t1 and the set value V1 for the second correction value VHOS, the set time t1 and the set value A1 for the second correction value AHOS are set at the degree detectable of the air-fuel ratio change while suppressing the degradation in operating performance of internal combustion engine 1.

Here, a period of time during which the target drive current APUMP is reduced by the set value A1 may be a period of time until the integrated value of engine rotating numbers and the integrated value of intake air amounts exceed the thresholds, instead of defining the period by the time, and furthermore, the set value A1 and the period of time during which the set value A1 is applied may be variably set according to the operating conditions, such as the engine load, the engine rotating speed and the like.

If the target drive current APUMP is temporarily reduced based on the second correction value AHOS in step S502, then in step S503, it is judged whether or not the change amount ΔAF of the air-fuel ratio due to the reduction of the target drive current APUMP is within a third threshold ΔAF3.

Here, when the discharge amount of fuel pump 12 is decreased due to the reduction of the target drive current APUMP, so that the supply pressure PF becomes lower than the set pressure SL of pressure regulator 14, the fuel amount injected per unit time by fuel injection valve 3 is decreased, so that the air-fuel ratio becomes leaner, and therefore, the change amount ΔAF of the air-fuel ratio indicates a leaning range of the air-fuel ratio associated with the reducing-correction of the target drive current APUMP.

Here, there is a delay until air-fuel ratio sensor 38 detects the air-fuel ratio change which occurs as a result that the target drive current APUMP is corrected based on the second correction value AHOS. Therefore, a period of time in which the delay is predicted is set as a sampling period for the air-fuel ratio detected by air-fuel ratio sensor 38. Then, a difference between a mean air-fuel ratio for when the correction based on the second correction value AHOS is not performed, and the air-fuel ratio on the most leaning side during the sampling period, may be detected as the air-fuel ratio change amount as a result that the drive current is corrected based on the second correction value AHOS.

Furthermore, the case in which the change amount ΔAF of the air-fuel ratio is within the third threshold ΔAF3 means a state in which the too much excessive fuel is obtained in the state in which the correction based on the second correction value AHOS is not performed, and even if the target drive current APUMP is reducing-corrected based on the second correction value AHOS, the fuel pressure is not decreased by the value corresponding to the second correction value AHOS.

Therefore, when it is judged in step S503 that the change amount ΔAF of the air-fuel ratio is within the third threshold ΔAF3, and then, the routine proceeds to step S504 in which the previous first correction value ALRN is increased by a correction value Y (AHOS≦Y), and the first correction value ALRN after increased is stored.

If the leaning change of the air-fuel ratio due to the temporary reduction of the target drive current APUMP is sufficiently small, it is judged that the excessive fuel of allowable minimum amount can be ensured even if the target drive current APUMP is reduced by at least the correction value Y, and then, the first correction value ALRN is increased by the correction value Y, while the target drive current APUMP being reduced by the correction value Y.

That is, the basic drive current ABASE is set to be higher so that the set pressure SL can be obtained as the fuel pressure PF, in other words, the excessive fuel is relieved from pressure regulator 14, even if the discharge pressure relative to the drive current becomes a minimum value due to various variation factors.

Therefore, an excessive amount of the basic drive current ABASE is decreased based on the first correction value ALRN, and if the too much excessive fuel is obtained, the target drive current APUMP is reduced in stepwise by the correction of the first correction value ALRN.

Incidentally, an initial value of the first correction value ALRN is 0, and may be a uniform correction value to be used for all operating regions. Or, the first correction value ALRN may be stored in updatable as an individual value for each of the plurality of operating regions which are separated based on the engine load and the engine rotating speed for example, so that the value stored in response to the corresponding operating region at the time can be updated, and the target drive current APUMP can be calculated based on the value stored in response to the corresponding operating region at the time.

On the other hand, if it is judged in step S503 that the change amount ΔAF of the air-fuel ratio is not within the third threshold ΔAF3, in other words, if the air-fuel ratio becomes leaner for over the predetermined value due to the temporary reduction of the target drive current APUMP, it is judged that the excessive fuel of allowable minimum amount is unable to be obtained if the drive current APUMP is further reduced by the correction value Y, and then, the routine proceeds to step S505.

In step S505, it is judged whether or not the change amount ΔAF of the air-fuel ratio, which occurred when the target drive current APUMP was temporarily reduced, is equal to or greater than a fourth threshold ΔAF4 (ΔAF4≧ΔAF3).

If the change amount ΔAF of the air-fuel ratio is less than the fourth threshold ΔAF4, it is judged that, although there is no room for further reducing the pump drive current APUMP, the target fuel pressure is obtained while the excessive fuel of allowable minimum amount being obtained, and this routine is terminated directly, so that the value of the first correction value ALRN is maintained as the previous value.

On the other hand, if the change amount ΔAF of the air-fuel ratio, which occurred when the drive current APUMP was temporarily reduced, is equal to or greater than the fourth threshold ΔAF4, it is judged that the excessive fuel of allowable minimum amount capable of absorbing the variations may not be ensured, and then, the routine proceeds to step S506.

In step S506, the previous first correction value ALRN is decreased by the correction value Y, and the first correction value ALRN after decreased is stored.

That is, if the change amount ΔAF of the air-fuel ratio, which occurred when the drive current APUMP was temporarily reduced, is equal to or greater than the fourth threshold ΔAF4, it is possible to estimate that the target drive current APUMP is excessively reduced based on the first correction value ALRN, and also, the excessive fuel amount is less than the allowable minimum amount. Therefore, the first correction value ALRN is decreased while the target drive current APUMP being increased, so that the excessive fuel over the allowable fuel amount can be obtained.

Then, as a result that the first correction value ALRN is decreased in step S506, if the change amount ΔAF of the air-fuel ratio, which occurred when the target drive current APUMP was temporarily reduced, becomes less than the fourth threshold ΔAF4, it is estimated that at least the excessive fuel of allowable minimum amount is obtained, and the decreasing-correction of the first correction value ALRN is stopped.

Accordingly, if the discharge pressure obtained relative to the target drive current APUMP is decreased due to the deterioration with time of fuel pump 12 or the like, the target drive current APUMP is increasingly corrected, so that the fuel pressure is regulated at the set pressure SL while the excessive amount of allowable minimum amount being obtained, in pressure regulator 14.

Incidentally, a decreasing-correction range of the first correction value ALRN in step S506 may be same as an increasing-correction range of the first correction value ALRN in step S504. Or, the decreasing-correction range of the first correction value ALRN in step S506 may be set to be wider than the increasing-correction range of the first correction value ALRN in step S504.

This is because, in the case in which the too much excessive fuel is obtained due to the excess of the drive current, although the electric power consumption is increased, the fuel pressure PF can be regulated at the set pressure SL and the air-fuel ratio controllability can be maintained, whereas, in the state in which the drive current is too low, since the fuel pressure PF is lower than the set pressure SL and there is a possibility of misfire due to the leaning of the air-fuel ratio, it is desired that the fuel pressure is restored promptly.

Furthermore, in the decreasing-correction of the first correction value ALRN in step S506 and in the increasing-correction of the first correction value ALRN in step S504, if the correction is consecutively performed for increasing (or decreasing), it is possible to make the correction range of the first correction value ALRN smaller in stepwise, and thus, the drive current can be further brought closer to the requisite minimum value.

The drive current of fuel pump 12 indicates the pump load and further, the fuel pressure PF, however, a correlation between the drive current and the fuel pressure is changed due to fuel properties, such as content rates of alcohol and additives, a resistance value change of a motor coil due to the heat of the motor for fuel pump 12 or the like. Therefore, the detection precision for the fuel pressure is lowered compared with the detection precision for the case in which the fuel pressure is detected by the pressure sensor.

Therefore, in the first embodiment described above, the change of the fuel pressure PF for when the drive voltage is temporarily reduced is detected as the change of the air-fuel ratio which is detected by air-fuel ratio sensor 38. However, the configuration may be such that the change of the fuel pressure is estimated based on the drive current, and if such a configuration is applied, the estimation of the change of the fuel pressure can be performed by using air-fuel ratio sensor 38, and also, by monitoring the drive current.

In the configuration in which the change of the fuel pressure is estimated based on the change of the pump drive current, the change of the fuel pressure can be estimated at responsibility higher than that for the case in which the change of the air-fuel ratio is detected, and it is possible to promptly correct the pump drive current to a level at which the excessive fuel amount becomes minimum without adversely effecting the operability of the engine, to thereby perform the learning in the transient state of internal combustion engine 1.

Incidentally, the first threshold ΔAF1 and the second threshold ΔAF2, and also, the third threshold ΔAF3 and the fourth threshold ΔAF4, may be the same values, but are set at values different from each other, that is, ΔAF1<ΔAF2 and ΔAF3<ΔAF4, in order to suppress hunting of the learning of pump drive voltage/pump drive current.

Furthermore, the value at which the excessive fuel becomes too much may be computed as the basic drive voltage VBASE or the basic target drive current ABASE, so that the first correction value VLRN or the first correction value ALRN can be updated, at each time when internal combustion engine 1 is operated, for the increasing side from 0 being the initial value, that is, only for the reduction side of the drive voltage or the target drive current. In this case, the processes of steps S205 and S206 in the flowchart of FIG. 3, and the processes of steps S505 and S506 in the flowchart of FIG. 5, are omitted.

Moreover, the value at which the excessive fuel of allowable minimum amount is obtained may be computed as the basic drive voltage VBASE or the basic target drive current ABASE, so that the first correction value VLRN or the first correction value ALRN can be updated, at each time when internal combustion engine 1 is operated, for the decreasing side, that is, only for the increasing side of the drive voltage or the target drive current. In this case, the processes of steps S203 and S204 in the flowchart of FIG. 3, and the processes of steps S503 and S504 in the flowchart of FIG. 5, are omitted, and the routine proceeds directly from step S203 to step S205, and from step S502 to step S505.

The entire contents of Japanese Patent Application No. 2010-065762 filed on Mar. 23, 2010, a priority of which is claimed, are incorporated herein by reference.

While only selected embodiments have been chosen to illustrate and describe the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined by the appended claims and their equivalents.

What is claimed is:

1. A fuel supply control apparatus for controlling an electric fuel pump in an internal combustion engine provided with the electric fuel pump for pumping fuel to a fuel injection valve and a pressure regulator for regulating fuel pressure at set pressure, comprising:

an electric power reducing unit which temporarily reduces driving electric power for the electric fuel pump when the internal combustion engine is in a stationary state;

a pressure estimating unit which estimates a change amount of the fuel pressure for when the driving electric power is temporarily reduced; and an electric power correcting unit which corrects the driving electric power based on the change amount of the fuel pressure, herein the electric power correcting unit includes:

a first comparing unit which judges whether or not the change amount of the fuel pressure is less than a first threshold;

a first correcting unit which reduces the driving electric power when the change amount of the fuel pressure is less than the first threshold;

a second comparing unit which judges whether or not the change amount of the fuel pressure is greater than a second threshold which is equal to or greater than the first threshold; and a second correcting unit which increases the driving electric power when the change amount of the fuel pressure is greater than the second threshold.

2. The apparatus according to claim 1, wherein the pressure estimating unit includes:

an air-fuel ratio sensor for detecting an air-fuel ratio of the internal combustion engine; and a computing unit which computes a change amount of the air-fuel ratio detected by the air-fuel ratio sensor as a value indicating the change amount of the fuel pressure.

3. The apparatus according to claim 2, wherein the computing unit samples an output from the air-fuel ratio sensor during a period of time which is delayed by a delay time in the detection by the air-fuel ratio sensor after the process of temporarily reducing the driving electric power by the electric power reducing unit.

4. The apparatus according to claim 1, wherein the electric power correcting unit includes:

a comparing unit which judges whether or not the change amount of the fuel pressure is greater than a threshold; and a correcting unit which increases the driving electric power when the change amount of the fuel pressure is greater than the threshold.

5. The apparatus according to claim 1, wherein the electric power correcting unit includes:

a comparing unit which judges whether or not the change amount of the fuel pressure is less than a threshold; and a correcting unit which reduces the driving electric power when the change amount of the fuel pressure is less than the threshold.

6. The apparatus according to claim 1, wherein the electric power reducing unit temporarily reduces a target drive current for the electric fuel pump, and the electric power correcting unit corrects the target drive current based on the change amount of the fuel pressure.

7. The apparatus according to claim 1, wherein the electric power reducing unit temporarily reduces a drive voltage for the electric fuel pump, and the pressure estimating unit estimates the change amount of the fuel pressure, based on a change of a drive current for the electric fuel pump for when the drive voltage is temporarily reduced.

8. The apparatus according to claim 1, wherein the electric power correcting unit includes:

a learning unit which learns a correction value of the driving electric power based on the change amount of the fuel pressure; and an electric power computing unit which computes the driving electric power based on a basic value of the driving electric power and the correction value thereof.

9. The apparatus according to claim 8, further comprising;

a basic value computing unit which computes the basic value of the driving electric power, based on a load of the internal combustion engine and a rotating speed thereof.

10. A fuel supply control apparatus for controlling an electric fuel pump in an internal combustion engine provided with the electric fuel pump for pumping fuel to a fuel injection valve and a pressure regulator for regulating fuel pressure at set pressure, comprising:

electric power reducing means for temporarily reducing driving electric power for the electric fuel pump when the internal combustion engine is in a stationary state;

pressure estimating means for estimating a change amount of the fuel pressure for when the driving electric power is temporarily reduced; and electric power correcting means for correcting the driving electric power based on the change amount of the fuel pressure, wherein the electric power correcting means includes:

first comparing means for judging whether or not the change amount of the fuel pressure is less than a first threshold;

first correcting means for reducing the driving electric power when the change amount of the fuel pressure less than the first threshold;

second comparing means for judging whether or not the change amount of the fuel pressure is greater than a second threshold which is equal to or greater than the first threshold; and second correcting means for increasing the driving electric power when the change amount of the fuel pressure is greater than the second threshold.

11. A fuel supply control method of controlling an electric fuel pump in an internal combustion engine provided with the electric fuel pump for pumping fuel to a fuel injection valve and a pressure regulator for regulating fuel pressure at set pressure, comprising:

temporarily reducing driving electric power for the electric fuel pump when the internal combustion engine is in a stationary state;

estimating a change amount of the fuel pressure for when the driving electric power is temporarily reduced; and correcting the driving electric power based on the change amount of the fuel pressure, wherein the correcting the driving electric power includes:

judging whether or not the change amount of the fuel pressure is less than a first threshold;

reducing the driving electric power when the change amount of the fuel pressure is less than the first threshold;

judging whether or not the change amount of the fuel pressure is greater than a second threshold which is equal to or greater than the first threshold; and increasing the driving electric power when the change amount of the fuel pressure is greater than the second threshold.

12. The method according to claim 11, wherein the estimating the change amount of the fuel pressure includes:

detecting an air-fuel ratio of the internal combustion engine; and computing a change amount of the air-fuel ratio as a value indicating the change amount of the fuel pressure.

13. The method according to claim 12, wherein the computing the change amount of the air-fuel ratio includes:

sampling the air-fuel ratio during a period of time which is delayed by a delay time in the detection of the air-fuel ratio after the process of temporarily reducing the driving electric power.

14. The method according to claim 11, wherein the correcting the driving electric power includes:

judging whether or not the change amount of the fuel pressure is greater than a threshold; and increasing the driving electric power when the change amount of the fuel pressure is greater than the threshold.

15. The method according to claim 11, wherein the correcting the driving electric power includes:

judging whether or not the change amount of the fuel pressure is less than a threshold; and reducing the driving electric power when the change amount of the fuel pressure is less than the threshold.

16. The method according to claim 11, wherein the temporarily reducing the driving electric power includes:

reducing a target drive current for the electric fuel pump, and the correcting the driving electric power includes:

correcting the target drive current based on the change amount of the fuel pressure.

17. The method according to claim 11, wherein the temporarily reducing the driving electric power includes:

temporarily reducing a drive voltage for the electric fuel pump, and the estimating the change amount of the fuel pressure includes:

estimating the change amount of the fuel pressure, based on a change of a drive current for the electric fuel pump for when the drive voltage is temporarily reduced.

18. The method according to claim 11, wherein the correcting the driving electric power includes:

learning a correction value of the driving electric power based on the change amount of the fuel pressure; and computing the driving electric power based on a basic value of the driving electric power and the correction value thereof.

19. The apparatus according to claim 1, further comprising:

a driving electric power unit which adjusts a base driving electric power for the electric fuel pump, to derive the driving electric power which is used to drive the electric fuel pump during a normal pump drive mode;

wherein the electric power reducing unit is more specifically for temporarily reducing the driving electric power for the electric fuel pump, for a limited testing time period, to a reduced driving electric power to temporarily effect the change amount of the fuel pressure which is used to test whether the electric power correcting unit should correct the driving electric power based on the change amount of the fuel pressure.

20. The method according to claim 11, further comprising:

adjusting a base driving electric power for the electric fuel pump, to derive the driving electric power which is used to drive the electric fuel pump during a normal pump drive mode;

wherein the temporarily reducing driving electric power is more specifically for temporarily reducing the driving electric power for the electric fuel pump, for a limited testing time period, to a reduced driving electric power to temporarily effect the change amount of the fuel pressure which is used to test whether the electric power correcting unit should correct the driving electric power based on the change amount of the fuel pressure.

* * * * *